US005296866A

United States Patent [19]

Sutton

[11] Patent Number: 5,296,866

[45] Date of Patent: Mar. 22, 1994

[54] ACTIVE ANTENNA

[75] Inventor: John F. Sutton, Greenbelt, Md.

[73] Assignee: The United States of America as represented by the Adminsitrator of the National Aeronautics and Space Administration, Washington, D.C.

[21] Appl. No.: 736,845

[22] Filed: Jul. 29, 1991

[51] Int. Cl.[5] ..... H01Q 1/26

[52] U.S. Cl. ..... 343/701; 343/856; 455/291

[58] Field of Search ..... 343/701, 850, 856, 860; 455/291; H01Q 1/26, 1/44

[56] References Cited

U.S. PATENT DOCUMENTS

| | | | |
|---|---|---|---|
| 3,716,867 | 2/1973 | Mayes et al. | 343/701 |
| 3,953,799 | 4/1976 | Albee | 343/701 |
| 4,383,260 | 5/1983 | Ryan | 343/701 |
| 4,442,434 | 4/1984 | Baekgaard | 343/701 |

FOREIGN PATENT DOCUMENTS

| | | | |
|---|---|---|---|
| 46-36380 | 10/1971 | Japan | 343/701 |

*Primary Examiner*—Michael C. Wimer

*Attorney, Agent, or Firm*—Ronald F. Sandler; R. Dennis Marchant; Guy M. Miller

[57] ABSTRACT

An antenna, which may be a search coil, is connected to an active circuit which provides negative impedances, each of which is of the order of magnitude of the positive impedances which characterize this active antenna. In one embodiment, one coil terminal is connected to an amplifier which drives a voltage-controlled current source that, in turn, drives a feedback coil which is coupled to the original search coil. In another embodiment that additionally exhibits an advantageous signal-to-noise characteristic, both terminals of the search coil are connected to a differential amplifier that, in turn, provides the control voltage for a current source, which, as in the first embodiment, drives the feedback winding. The feedback coil is wound to provide positive feedback by additive superposition of both coil fields.

The positive feedback provided by the feedback current lowers the antenna impedance which, in turn, increases the effective area of the antenna. This circuit configuration incorporates a differentiation inherent in the fundamental characteristic of a coil, which is sensitive to the rate-of-change of the magnetic field. The outstanding stability of this active antenna may be attributed to the inherent accuracy of this differentiation performed by the antenna coil, to the particular circuit configurations and to the particular form of feedback employed.

6 Claims, 2 Drawing Sheets

ACTIVE ANTENNA

ORIGIN OF THE INVENTION

The invention described herein was made by an employee of the United States Government, and may be manufactured and used by or for the Government for government purposes without the payment of any royalties thereon or therefor.

TECHNICAL FIELD

This invention pertains to antennas, and, more particularly, to active antennas.

PRIOR ART

Historically, in the 1920s, experimenters commonly employed regeneration in simple vacuum tube radio receivers. Typically these early receivers consisted of an inductor-capacitor (LC) tuned circuit coupled to a long-wire antenna and to the grid circuit of a vacuum triode. Some of the energy from the anode circuit was introduced as positive feedback into the grid-antenna circuit. Such feedback is equivalent to introduction of negative resistance into the antenna-grid circuit. Because of the desire to obtain maximum sensitivity, these circuits were usually tuned close to the point of instability. As a result, any small variation of antenna impedance, which could be produced by wind-induced motion of the antenna, for example, often was sufficient to cause the circuit to become unstable and go into oscillation. The broadcast bands became cluttered with spurious signals from many oscillating detectors, so the practice of applying regeneration to the antenna-grid circuits fell into disuse. The regeneration was subsequently applied to a second amplifier stage which was isolated from the antenna circuit by a buffer tube circuit. This practice resulted in the substantial reduction of the spurious signals on the broadcast band, but the removal of feedback from the antenna circuit also resulted in substantial reduction of sensitivity.

The reason why an antenna with regeneration has greater sensitivity than one without regeneration may be understood in terms of the concept of antenna "effective area." The first to explain why an antenna may have an effective area larger than its geometric area was Reinhold Rudenberg in 1908, in his article entitled, "Der Empfang Electrischer Wellen in der Drahtlosen Telegraphie", published in Annalen der Physik, Band, 25, P.446. Fundamentally, Rudenberg teaches that the antenna interacts with an incoming field, which may be approximately a plane wave, causing a current to flow in the antenna by induction. The current, which may be enhanced by regeneration, in turn, produces a field in the vicinity of the antenna, which field, in turn, interacts with the incoming field in such a way that the incoming field lines are bent. The field lines are bent in such a way that energy is caused to flow from a relatively large portion of the incoming wave front, having the effect of absorbing energy from the wave front into the antenna from an area of the wave front which is much larger than the geometrical area of the antenna. Articles by Ambrose Fleming: "On Atoms of Action, Electricity, and Light", published in Philosophical Magazine 14, P.591, July–December 1932, by Craig F. Bohren: "How Can a Particle Absorb More Than the Light Incident on It?", Am. J. Phys. 51, No. 4, P.323, April, 1983, and by H. Paul and R. Fischer: "Light Absorption by a Dipole, Sov. Phys. Usp.26, No.10, P.923, October, 1983, generally elaborate on the teaching of Rudenberg. It should be noted at this point that these teachings were directed at tuned antennas or mathematically analogous situations encountered in atomic physics.

Thus, from teachings such as Rudenberg, as well as Fleming, Bohren, and Paul and Fischer, antennas, at least tuned, or resonant, antennas may be said to have a much greater effective area than their geometric area. Regeneration reduces the resistance of the antenna circuit, resulting in increased antenna current and, therefore, increased antenna-field interaction, resulting in absorption of energy from an even larger effective area of the incoming field. In effect, these teachings explain an inherent physical phenomenon, rather than teaching how to achieve a particular effect. These teachings do not include how to maximize the effect or how to provide such an effect in the broad band case. With a tuned antenna there is always a tuned circuit including the antenna, where a capacitive reactance is effectively cancelled by an inductive reactance which leads, in turn, to a large circulating current in the resonant circuit, which results in the production of a field. This field, in turn, interacts with the incoming field.

A recent approach in the prior art has employed an operational amplifier in a gain-of-two configuration with a replica of the antenna coil. The antenna coil replica in this active circuit configuration develops a negative of the complex impedance of the replica coil. If the complex impedance of the replica coil is exactly the same as that of the antenna coil, then the antenna coil-active circuit combination has a nearly net zero impedance and functions as a broad band antenna. A disadvantage of this approach is the difficulty of fabricating the replica coil to be electrically identical to the antenna coil. Also, stray capacitances and stray inductances may cause instability.

Another recent approach in the prior art applies an active circuit which develops a negative inductive reactance that is connected to an antenna coil to effectively cancel the real positive inductive reactance of the antenna coil. In this circuit, the resistance of the wire and the distributed capacitance of the coil are not negated by the particular choice of circuit configuration or by feedback.

While not prior art, another recent technique employs an active antenna with an active amplifier that presents the antenna with a negative driving point impedance that consists of a negative resistance in series with a negative inductive reactance at an input of the amplifier.

The above-mentioned recent developments continue to suffer from the historic problems of instability caused by stray inductive reactances and stray capacitive reactances, which have been a fundamental problem in this art since the 1920's. Because of these instability problems, these circuits can not be adjusted to have total antenna circuit impedances as small as desired. The present invention supplies positive feedback in a controlled manner which, due to the particular circuit configuration employed, is inherently more stable against instabilities caused by stray inductive reactances and stray capacitive reactances. Therefore, this new circuit configuration can be adjusted so that the total antenna circuit impedance is much smaller than can be reliably attained with other circuit configurations. Because of the smaller total antenna circuit impedance that may be achieved without instability, the new configuration causes the effective area of the antenna to be much larger than that attainable by other configurations, resulting in increased antenna sensitivity. Also, the differential version of the present invention has a signal-to-noise ratio advantage and inherent insensitivity to electrostatic pickup, i.e., capacitively coupled interference, which other circuit configurations do not have.

STATEMENT OF THE INVENTION

Accordingly, it is an object of this invention to provide an improved antenna system.

It is another object of this invention to provide an improved active antenna system.

It is yet another object of this invention to provide an improved broadband active antenna system.

It is yet another object of this invention to provide an improved active antenna system having an extremely low, predetermined antenna circuit impedance.

It is a further object of this invention to provide an improved active antenna system by incorporating a negative impedance in the antenna system.

It is a further object of this invention to provide an improved, extremely stable active antenna system by including a negative impedance developed by providing positive feedback from a voltage-controlled current source to the antenna.

It is a further object of this invention to provide an improved, extremely stable low noise active antenna system by including a differential amplifier and a negative impedance developed by providing positive feedback from a voltage-controlled current source to the antenna.

Briefly, the foregoing and other objects may be obtained by providing an antenna with positive inductance and positive resistance, a circuit with negative inductance and negative resistance, each of which impedances, respectively, having magnitudes that are in the order of the positive inductance and positive resistance of the antenna, but somewhat less, the antenna and the circuit being connected in a fashion whereby the positive and negative impedances add algebraically and the total antenna-plus-circuit impedance appears as a slightly positive resistance and inductance.

DETAILED DESCRIPTION OF THE INVENTION

It is desirable to have a very sensitive antenna for the purpose of detecting low level fields, e.g., low level magnetic fields. It is also desirable to have this sensitive antenna exhibit a broadband frequency characteristic for, among other reasons, to satisfy the requirements of modern, fast-Fourier transform data analysis instruments, where it is often advantageous to analyze broadband signals rather than single-frequency or narrow band signals. For example, the antennas commonly employed for sensing ELF magnetic fields consist of search coils comprised of several thousand turns of copper wire wound around high permeability, low loss cores, such as ferrite rods. To enhance the performance of such a search coil antenna, it is desirable to effectively reduce the wire resistance and the inductive reactance of the coil, both of which impede the signal-generated current flow in the coil. A low coil impedance implies a large coil current, which, in turn, implies a large effective area and hence, a high sensitivity. By careful design, the coil resistance and inductance can be somewhat reduced. It is a purpose of this invention to further reduce the effective coil impedance to arbitrarily small values by electronic means.

In most circumstances, a search coil impedance may be shown to be, to a good approximation, a resistance $R_A$ in series with an inductance $L_A$. As discussed above, a search coil with only inductance and resistance and no capacitance, and no impedances coupled in from the environment, is defined as an ideal search coil. If such a coil were connected in series with a negative impedance circuit, i.e., an appropriate, in terms of magnitude, negative resistance in series with an appropriate, in terms of magnitude, negative inductive reactance, the total combined impedance of the coil and the negative impedance circuit could be made as small as desired. If the total combined impedance is made positive, but very small, a very sensitive search coil system would result.

Figure 1:
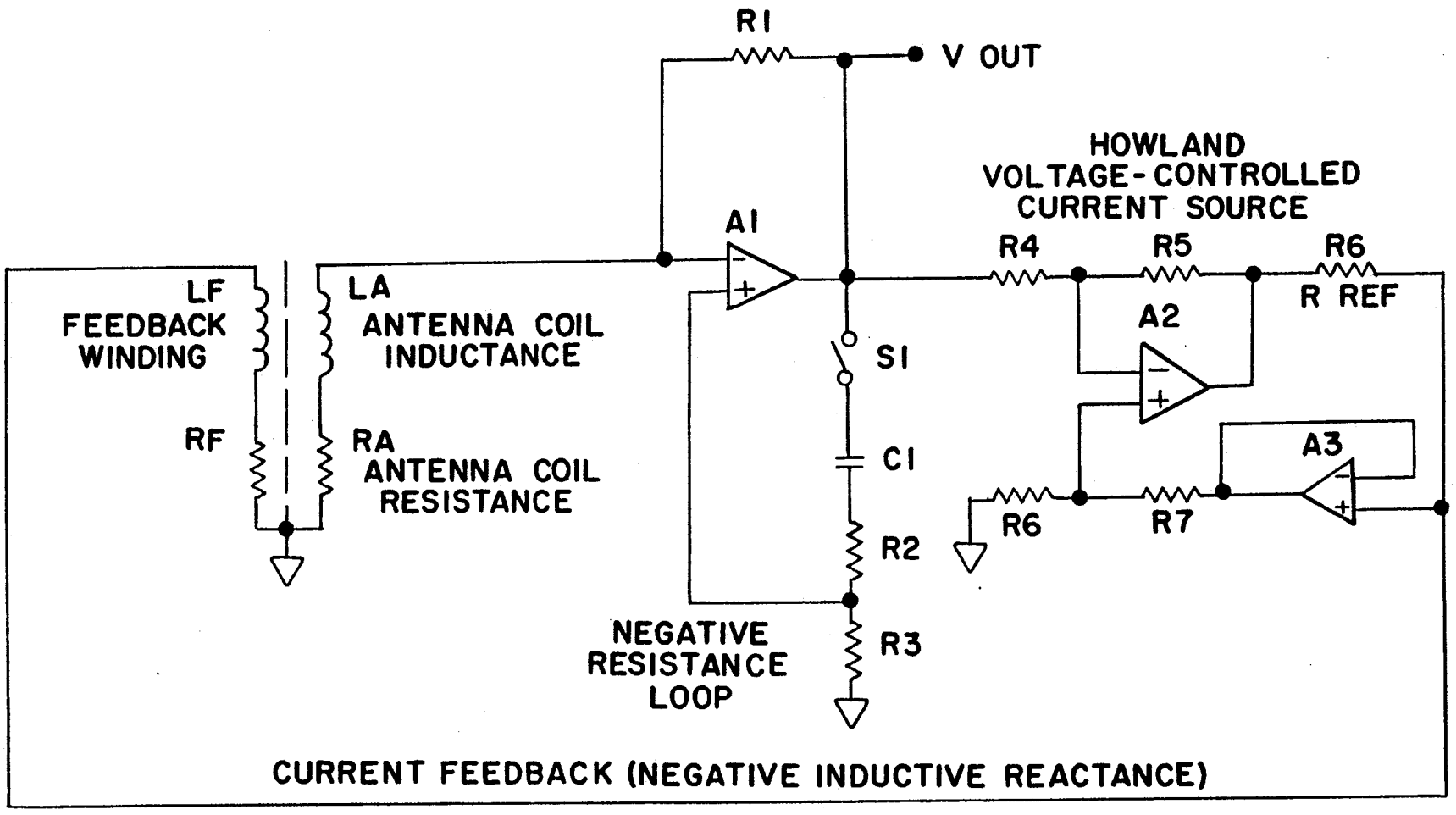
FIG. 1 is a schematic diagram of a preferred embodiment of a low impedance, active antenna system according to the invention.

One circuit employing an operational amplifier to furnish the required negative resistance and negative inductance is shown as the active antenna circuit of FIG. 1. The antenna, in the form of a search coil, broken up into its components, $R_A$ and $L_A$, is connected between the signal common and the inverting input of operational amplifier A1, which may be a Precision Monolithics OP-27. A resistor R1 is connected between the inverting input of A1 and its output. A dc blocking capacitor C1 is connected in series with switch S1 and resistors R2 and R3 to signal common. The noninverting input of A1 is connected to the juncture of R2 and R3. A voltage-controlled current source is formed with resistors R4, R5, R6, R7, R8, and amplifiers A2 and A3. Resistor R4 is connected between the output of A1 and the inverting input of A2. R5 is connected from the output of A2 to the inverting input of A2. R6 is connected from the noninverting input of A2 to signal common. R7 is connected from the noninverting input of A2 to the output of A3, which is also connected to the inverting input of A3. The reference resistor R8 is connected between the output of A2 and the noninverting input of A3 which is connected, in turn, to one terminal of the feedback winding, $L_F$-$R_F$. The other terminal of the feedback winding is connected to circuit common. Switch S1 is provided for convenience in turning the negative resistance feedback loop on and off.

In the active antenna configuration of FIG. 1, the current generated by antenna coil $L_A$-$R_A$ passes through resistor R1, developing a voltage at the output of A1. This voltage is then applied to resistor R4, which is an input port of the Howland voltage-controlled current source formed by A2, A3, and resistors R4, R5, R6, R7, and R8. The other input port of the current source is one terminal of R6, which is grounded. The output current, which is determined by the ratio of the voltage at the output of A1 to the magnitude of the resistance of R8 if R4=R5=R6=R7, is then fed to the feedback coil $L_F$-$R_F$. Typical values for the components shown in FIG. 1 are: R1=10k, R2=100k, R3=10 Ohms, R4=R5=R6=R7=10k, R8=30k, and C1=1000uF. Amplifiers A1, A2, and A3 may be OP-27s. The Howland voltage-controlled current source produces a current proportional to the voltage output from amplifier A1, and inversely proportional to the magnitude of the reference resistor R8. This current is caused to flow through the feedback winding, $L_F$-$R_F$, on the antenna coil. Electrostatic shielding is provided to reduce capacitive coupling between the two windings. In summary, the antenna search coil drives a current into amplifier A1, which functions as an inverting current-to-voltage converter, which, in turn, drives the Howland voltage controlled current source. The current source drives the feedback winding $L_F$-$R_F$ which is designed to inductively couple a magnetic field to the search coil. Whether or not the voltage-controlled current source inverts with respect to sign is irrelevant, in the sense that the coil can be wound in any direction desired, as long as the magnetic fields from the feedback coil and the antenna coil are additive.

The antenna coil is sensitive to rate-of-change of magnetic field, and therefore generates an emf directly proportional to the signal field magnitude and directly proportional to its frequency. The inductance $L_A$ of the antenna coil has a reactance which also increases directly proportional to frequency. Therefore, by Ohm's Law, the current in the antenna coil which flows into the inverting input of amplifier A1 is independent of frequency. This current flows through resistor R1 producing the output voltage Vout, the magnitude of which is also independent of frequency. The voltage-controlled current source then generates a current proportional to the output voltage of amplifier A1 which is, in turn, proportional to the antenna coil current. The current from the current source flows through the feedback winding, $L_F$-$R_F$, on the antenna coil. The current in the feedback winding produces, in turn, a magnetic field the magnitude of which is independent of frequency. The antenna coil senses the rate-of-change of the resulting magnetic field and produces an emf proportional to frequency. Hence, with feedback applied, the antenna coil senses the rate-of-change of the superposition of the original signal field and an additional field, proportional to it, produced by the current from the current source flowing through the feedback winding. The resulting antenna coil current and the output voltage, Vout, proportional to it, remain independent of frequency, but are larger when this feedback is applied than they would be in the absence of feedback. The antenna coil with this particular form of feedback applied behaves, then, exactly as it would without feedback applied but with less inductive reactance. This is equivalent to saying that the inductive reactance of the antenna coil has been reduced by the application of this particular form of feedback.

When switch S1 is closed, negative resistance is introduced in series with the antenna coil, as is well known in the art, through the introduction of an RC network consisting of C1, R2, and R3. This network, as usually configured, provides positive feedback that is essentially independent of frequency, with C1 being a relatively large-valued capacitance employed only to provide blocking of dc current, and R2 and R3 forming a simple voltage divider. The combination of the two feedback loops, the voltage feedback loop, which introduces negative resistance when S1 is closed, and the current feedback loop, which introduces negative inductive reactance, then serve to reduce the total antenna circuit impedance to a small net effective resistance in series with a small net effective inductive reactance. This, then, results in a relatively large current flow through the antenna coil in response to the rate-of-change of the magnetic field being sensed. The relatively large coil current then causes the antenna coil to develop a magnetic dipole field which, in turn, increases the effective area, and hence increases the active antenna sensitivity over that which it would have without the application of feedback. This greater sensitivity is broad band, and may be characterized by an essentially frequency-independent response over a frequency range at least four decades wide.

It should be noted that, with only the negative inductive reactance feedback applied, the antenna coil is connected between a signal ground and a virtual ground provided at the inverting input of operational amplifier A1. Because no potential difference can exist across the coil when both ends are maintained at ground potential, any distributed winding capacitance cannot become charged, and therefore the capacitance is effectively removed from the circuit. With only a small amount of negative resistance feedback applied, there is still very little effect from the distributed winding capacitance of the coil. Also, the fact that the current source has a high output impedance means that the line and feedback winding capacitances tend to attenuate the positive current feedback at high frequencies. Both of these effects contribute to the inherent stability of this preferred embodiment of the invention. Another factor which contributes to the outstanding stability of the active antenna of this invention is the perfect differentiation provided by the antenna coil, which is sensitive to the rate-of-change of the magnetic field. No active circuit voltage differentiator could achieve the level of accuracy of the differentiation inherent in the nature of the functioning of the antenna coil.

Up to this point we have considered, for the purpose of simplicity of analysis, the case of an idealized search coil having only a positive resistance and a positive inductance. In reality, impedances will couple into the antenna circuit from the environment. In some cases, this coupling may be significant. In any event, as a practical matter, the active antenna is tuned so that the total antenna circuit resistance, including environmentally-coupled resistance, is small, but positive, and the total antenna circuit inductance, including environmentally-coupled inductance, is also small, but positive. The negative resistance tuning is accomplished most conveniently by adjusting the voltage divider attenuation factor provided by resistors R2 and R3 through proper selection of the values of resistors R2 and R3. The negative inductive reactance is tuned most conveniently by adjusting the value of the reference resistor, R8. In some cases, environment-coupled capacitive effects must also be considered. The antenna impedances and the corresponding negative circuit impedances could be more complex than discussed here. Under most circumstances our simplified model is effective.

In some circumstances, where the real positive capacitance associated with a particular antenna coil is large, it may be desirable to add a negative capacitance to the active antenna circuit in order to remove the effect of the capacitance. In principle, a negative capacitance can be added with active circuitry which is analogous to that disclosed herein to provide the negative resistance and negative inductance. An appropriate circuit configuration would be a capacitance connected across a gain-of-two circuit and connected to the antenna terminal.

It is good practice to wind the antenna coil with wire of great enough thickness so that the winding resistance is low enough that excessive Johnson noise will not be generated. As discussed above, the separate voltage feedback loop is used to apply negative resistance to the antenna coil circuit to effectively remove most of the remaining coil resistance. This negative resistance feedback loop can be applied or removed with minimal effect to the stability of the active antenna circuit. At low frequencies, where the antenna coil resistance dominates the total coil impedance, negative resistance feedback is desirable and necessary to achieve a frequency response that is independent of frequency. At higher frequencies, where the antenna coil inductive reactance dominates the total antenna coil impedance, the negative resistance feedback loop may not be necessary and may be disconnected, as by opening switch S1.

Figure 2:
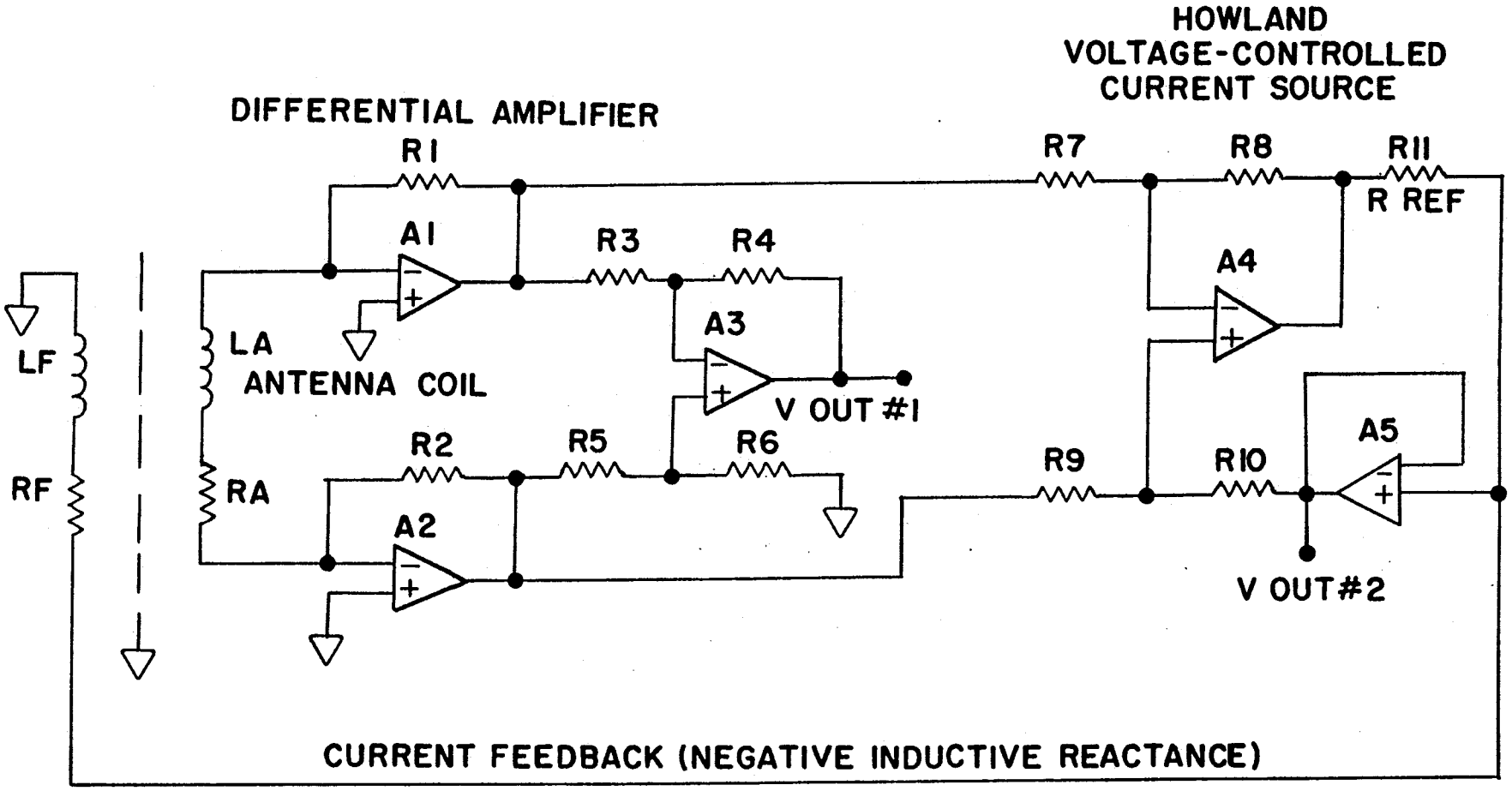
FIG. 2 is a schematic diagram of another preferred embodiment of a low impedance, differentially driven low noise active antenna system.

A differential form of the preferred embodiment of the active antenna of this invention is shown in FIG. 2. In this differential active antenna configuration, the antenna coil $L_A$-$R_A$, is connected between the inverting inputs of operational amplifiers A1 and A2. Amplifiers A1 and A2 have preferably matched resistors R1 and R2, respectively, connected between their inverting inputs and their outputs. The output of A1 is connected via resistor R7 to the inverting input of A4. R8 is connected between the inverting input of A4 and the output of A4. R9 is connected between the output of A2 and the noninverting input of A4. R10 is connected between the noninverting input of A4 and the output of A5. Reference resistor R11 is connected between the output of A4 and the noninverting input of A5 as well as to the feedback coil $L_F$-$R_F$. The output of A5 is connected to the inverting input of A5. The output of A1 is connected via resistor R3 to the inverting input of A3. R4 is connected between the output of A3 and the inverting input of A3 while R5 is connected between the output of A2 and the noninverting input of A3. R6 is connected between the circuit common and the noninverting input of A3. Preferably, R3 is matched in value to R5 and R4 is matched to R6. Also, R7 is matched to R9 and R8 is matched to R10. If desired, feedback which introduces negative resistance into the antenna-amplifier circuit can be added in a manner similar to that which may be developed by A1 in FIG. 1, except that two identical feedback networks would be employed in A1 and A2 in FIG. 2.

The current generated by the antenna coil $L_A$-$R_A$ passes into the inverting input of amplifier A1 and, at the same time, out of the inverting input of amplifier A2. Amplifiers A1, A2, and resistors Rl and R2 are in a differential transimpedance configuration, i.e., a differential voltage output is produced which is proportional to the differential current input. The antenna coil current passes simultaneously through resistors Rl and R2 generating, in the process, equal and opposite voltages at the outputs of amplifiers A1 and A2. These equal and opposite voltages are applied to one terminal of each of the resistors R3 and R5, which serve as the two input terminals of the differential amplifier formed by operational amplifier A3 and resistors R3, R4, R5, and R6. The resulting voltage at the output of amplifier A3 is proportional to the current in the antenna coil. The same equal and opposite voltages at the outputs of amplifiers A1 and A2 are also applied to one terminal of each of the resistors R7 and R9, which serve as the two input terminals of the Howland voltage-controlled current source formed by amplifiers A4 and A5, and resistors R7, R8, R9, R10, and R11. The current source produces a current, through R11 and the feedback coil $L_F$-$R_F$ connected to it, which is proportional to the difference in the voltages at the outputs of amplifiers A1 and A2. Typical component values for the active antenna configuration of FIG. 2 are: R1=R2=10k, R3=R4=R5=R6=R7=R8=R9=R10=10k, and R=30k. Amplifiers A1, A2, A3, A4, and A5 may be OP-27. In this instance, both the configuration and function of the Howland voltage-controlled current source is essentially the same as that depicted in FIG. 1, the difference being that in FIG. 1 the current source has a single input drive while the source in FIG. 2 employs a dual input drive to accommodate the differential outputs from A1 and A2.

This differential configuration provides better signal-to-noise ratio performance than the single-amplifier configuration of FIG. 1. The same antenna coil current that is amplified by A1 is also amplified by A2. Because these two signals are coherent, while the inputted noise of the individual amplifiers is incoherent, the use of this balanced differential amplifier circuit results in a square-root-of-two signal/noise ratio advantage over a single amplifier circuit. Also, because of its high common mode rejection ratio, this differential amplifier configuration reduces the effects of interference from common-mode electrostatic pickup by the antenna coil. This interference rejection, or "electronic shielding", greatly reduces the severity of the physical electrostatic shielding requirements for the antenna coil.

It should be noted that certain details of the circuitry shown in FIGS. 1 and 2 could be changed without departing from the spirit of the invention. For example, although a Howland current source is shown, other active or passive current source configurations, well known to those skilled in the art, could be employed.

I claim:

1. An active antenna including an antenna, a feedback winding, and circuit means:

said antenna having positive inductance and positive resistance, including any impedances coupled into said antenna from the environment, said antenna being field coupled to said feedback winding;

said circuit means including an operational amplifier and a voltage-controlled current source, the output of said operational amplifier connected to said voltage-controlled current source, said circuit means providing a negative inductance and a negative resistance, the magnitude of said negative inductance being on the order of said antenna positive inductance but somewhat less, and the magnitude of said negative resistance being on the order of said antenna positive resistance but somewhat less;

means to connect the antenna and said circuit means in a configuration which provides an algebraic addition of said positive and negative inductances and resistances, with the total active antenna circuit impedance being a very small, but positive, series inductance and resistance;

said antenna being connected to the inverting input of said operational amplifier, and said voltage-controlled current source being controlled by the output of said amplifier and providing current to said feedback winding.

2. The active antenna circuit of claim 1 wherein said antenna positive inductance and positive resistance is in series, said circuit means negative inductance and negative resistance is in series, said positive inductance and positive resistance being in parallel with said negative inductance and negative resistance, and positive inductance, positive resistance, negative inductance, and negative resistance forming a series loop comprising said total active antenna circuit impedance.

3. The active antenna circuit of claim 1 wherein a resistor is connected between the output and the inverting input of said operational amplifier.

4. An active antenna including an antenna, a feedback winding, and circuit means:

said antenna having positive inductance and positive resistance, including any impedances coupled into said antenna from the environment, said antenna being field coupled to said feedback winding;

said circuit means including two operational amplifiers connected in a differential amplifier configuration and a voltage-controlled current source, the output of said differential amplifier driving said voltage controlled current source, said circuit means providing a negative inductance and a negative resistance, the magnitude of said negative inductance being on the order of said antenna positive inductance but somewhat less, and the magnitude of said negative resistance being on the order of said antenna positive resistance but somewhat less;

means to connect the antenna and said circuit means in a configuration which provides an algebraic addition of said positive and negative inductances and resistances, with the total active antenna circuit impedance being a very small, but positive, series inductance and resistance;

said antenna being connected to the inverting input of said operational amplifier, and said voltage-controlled current source being controlled by the output of said operational amplifiers and providing current to said feedback winding.

5. The active antenna circuit of claim 4 wherein said antenna positive inductance and positive resistance is in series, said circuit means negative inductance and negative resistance is in series, said positive inductance and positive resistance being in parallel with said negative inductance and negative resistance, said positive inductance, positive resistance, negative inductance, and negative resistance forming a series loop comprising said total active antenna circuit impedance.

6. The active antenna circuit of claim 4 wherein a resistor is connected between the output and the inverting input of each of said operational amplifiers, respectively.

* * * * *